US012372317B2

(12) United States Patent
Reis-Green

(10) Patent No.: US 12,372,317 B2
(45) Date of Patent: Jul. 29, 2025

(54) BOLT CARRIER WITH GAS EXHAUST POCKET

(71) Applicant: Austin Gabriel Reis-Green, Watertown, WI (US)

(72) Inventor: Austin Gabriel Reis-Green, Watertown, WI (US)

( * ) Notice: Subject to any disclaimer, the term of this patent is extended or adjusted under 35 U.S.C. 154(b) by 0 days.

(21) Appl. No.: 18/811,964

(22) Filed: Aug. 22, 2024

(65) Prior Publication Data

US 2025/0067530 A1 Feb. 27, 2025

Related U.S. Application Data

(60) Provisional application No. 63/534,025, filed on Aug. 22, 2023.

(51) Int. Cl.

| | |
|---|---|
| ***F41A 3/26*** | (2006.01) |
| ***F41A 3/16*** | (2006.01) |
| ***F41A 5/24*** | (2006.01) |
| ***F41A 5/26*** | (2006.01) |

(52) U.S. Cl.
CPC . *F41A 5/26* (2013.01); *F41A 3/16* (2013.01)

(58) Field of Classification Search
None
See application file for complete search history.

(56) References Cited

U.S. PATENT DOCUMENTS

| | | | | | |
|---|---|---|---|---|---|
| 2,951,424 | A * | 9/1960 | Stoner | F41A 3/26 | 89/185 |
| 3,236,155 | A | 2/1966 | Sturtevant | | |
| 5,272,956 | A * | 12/1993 | Hudson | F41A 5/28 | 89/193 |
| 5,351,598 | A * | 10/1994 | Schuetz | F41A 5/18 | 89/185 |
| 5,551,179 | A * | 9/1996 | Young | F41A 3/12 | 42/16 |
| 5,918,401 | A * | 7/1999 | Rowlands | F41A 35/02 | 42/16 |
| 9,303,931 | B2 * | 4/2016 | Jensen | F41A 3/64 | |
| 9,372,038 | B1 * | 6/2016 | Sylvester | F41A 3/26 | |
| 9,528,783 | B2 * | 12/2016 | Beaty | F41A 5/28 | |
| 10,330,410 | B2 * | 6/2019 | Miller | F41A 19/13 | |
| 10,378,839 | B1 * | 8/2019 | Bratic | F41A 5/24 | |
| 10,718,577 | B1 * | 7/2020 | Sylvester | F41A 5/26 | |
| 10,948,249 | B2 * | 3/2021 | Overstreet | F41A 3/30 | |
| 11,898,815 | B2 * | 2/2024 | Wilkinson | F41A 21/48 | |
| 2011/0185886 | A1 * | 8/2011 | Boutin, Jr. | F41A 5/24 | 89/191.01 |
| 2015/0135942 | A1 * | 5/2015 | Gomez | F41A 3/26 | 89/191.01 |
| 2016/0123685 | A1 * | 5/2016 | Oglesby | F41A 13/00 | 89/180 |
| 2018/0356171 | A1 * | 12/2018 | Brown | F41A 3/26 | |

* cited by examiner

*Primary Examiner* — Derrick R Morgan
(74) *Attorney, Agent, or Firm* — Dunlap Bennett & Ludwig, PLLC

(57) ABSTRACT

A bolt carrier for gas impingement rifles equipped with a sound suppressor mechanism. The bolt carrier is configured to tortuously direct gas to a gas exhaust pocket and into a magazine well of the gas impingement rifle, thereby lessening ejection port light signature and significantly reducing the peak noise in the vicinity of the firer's ears. The gas exhaust pocket of the bolt carrier also improves the operator air quality and reduces bolt lug and chamber fouling associated with the other devices that have attempted to address the noise problem.

5 Claims, 5 Drawing Sheets

BOLT CARRIER WITH GAS EXHAUST POCKET

CROSS-REFERENCE TO RELATED APPLICATION

This application claims the benefit of priority of U.S. provisional application No. 63/534,025, filed 22 Aug. 2023, the contents of which are herein incorporated by reference.

BACKGROUND OF THE INVENTION

The present invention relates to breechloading firearms and, more particularly, to a bolt carrier with a gas exhaust pocket.

A bolt is the part of a repeating, breechloading firearm that locks the rear opening (breech) of the barrel chamber while the propellant burns, and that moves back and forward to facilitate loading/unloading of cartridges from the magazine. The firing pin and extractor are often component parts of a bolt carrier assembly which houses the bolt.

In a self-loading firearm the bolt cycles back and forward between each shot, propelled back by recoil (recoil operation) or the expanding gas (blowback and gas operation) and forward by a spring. When it moves back, the extractor pulls the spent casing of the previous shot from the chamber, and once the case is clear out of the chamber, the ejector kicks the case out of the firearm. When the bolt moves forward, it picks up a new cartridge from the magazine and pushes it into the chamber.

In many automatic firearms that use gas operation, the bolt itself is housed within the larger bolt carrier, which contains additional parts and receives rearward push via a gas tube fluidly coupled to a gas key that in turn directs gas into a space between the bolt carrier and the gas rings on the bolt. During this gas operation, expanding gas resulting from firing a bullet forces the bolt carrier rearward in relation to the breach-locked bolt's gas rings, exposing carrier gas exhaust ports which allow the gas to escape after the bolt carrier has obtained enough momentum to complete the unlocking and functioning cycle under its own inertia. In the embodiment of this invention, gas escaping through the gas exhaust ports fills a bolt carrier pocket defined by the bolt carrier and its close operative association to the housing or receiver.

The prior art bolt carriers in direct impingement rifles discharge exhaust gas directly to the atmosphere proximate to the shooter's ears through the ejection port. This causes peak sound in conjunction with muzzle attached sound suppressors, generally in the upper 140 DB range unweighted or in the lower 140 range A weighted. This level of sound is believed by most people and acoustic scientists to be harmful to human hearing.

In another instance of prior art, the KAK K-spec carrier provides 90-degree vent holes in the magazine feed lip clearance cuts on the bottom surface of the K-spec carrier that downwardly vent gas against the wide portion of cartridge cases of the magazine, where the cartridge cases are approximately 0.377" diameter, double wide stacked therein. Thus, the exhausted gas hits a congested magazine, which in turn sprays the gas into the gap of the magazine's feed lip, also deflecting the gas forward and rearward until a portion is undesirably driven rearward into the fire control pocket and a second portion forward into the chamber. Gas interaction with the chamber and fire control pocket has an undesired effect of removing lubrication from the interacting components. Gas pressurization of the upper and lower housings or receivers causes bleed off as gas to exit the gap between the upper and lower receiver in the vicinity of the airway of the shooter. The ejection port side feed lip clearance located port is very proximal to the ejection port located about 5/16 of an inch from the ejection port. This allows some high-pressure gas to exit the cartridge ejection port with a louder measured sound than the bolt carrier of the present invention, since this pushed gas is not being effectively directed nor allowed to reduce in pressure prior to exiting the system.

The only prior art system with alternate exhaust port locations exhausts only in an area with direct communication to the bolt and chamber area as well as to the fire control pocket, and the ejection port.

In order for the bolt carrier to articulate far enough rearward to position the gas rings on the bolt in front of the bolt carrier exhaust ports to allow exhaust to occur, the bolt carrier is open about three eighths of an inch. This means the area where the only known prior art system with a different exhaust location from standard bolt carriers is exhausting gas into an open area of the firearm with communication directly to the chamber and to the ejection port. This creates chamber fouling that is undesirable for reliable feeding and will promote wear, friction, and undesirable interaction with the bolt's locking lug sliding function in the barrel extension where the barrel portion of the locking lugs are located. The bolt can run with some fouling, but it is undesirable for it to do so as it is more likely to eventually lead to reliability issues. It is the best practice for this area to be cleaner, and lubricated. Venting directly into a chamber with open communication to the open ejection port also increases the resulting peak operating noise level, over that of the bolt carrier of the exemplary embodiment of the invention.

The prior art standard bolt carrier creates an unsafe noise level that is nearly impossible to overcome to safe levels solely using muzzle mounted sound suppressors. The prior art bolt carrier also occasionally exhibits ejection port flash-a light signature that is undesirable for military and law enforcement end users who are concerned with visual light signatures and light signatures on night vision devices.

As can be seen, there is a need for a bolt carrier with an inherent gas exhaust pocket that directs exhaust gases via a forward pocket wall into an open front part of the magazine under the bolt carrier where the gasses can expand, reduce in pressure, and exit via an more strategic path to the cartridge ejection port, with less interaction with the chamber and fire control pocket.

SUMMARY OF THE INVENTION

The invention reduces the peak sound of the vented exhaust gas from the ejection port only when a firearm sound suppressor is mounted to the firearm. Without a firearm sound suppressor attached to the barrel of the firearm, the muzzle noise of the rifle is louder than the bolt carrier exhaust noise. This renders the present invention useful for sound reduction, only for firearms that are already being used with barrel attached sound suppressors. Note, "attached" here includes integral suppressors i.e., those that are built natively into a barrel assembly.

The invention reduces the peak sound of the vented exhaust gas from the ejection port, only measurable when a firearm sound suppressor is mounted to the firearms barrel muzzle. Without a firearm sound suppressor attached to the barrel of the firearm, the muzzle noise of the rifle is louder than the bolt carrier exhaust noise. This renders the invention useful for providing additional operator safety through more than doubling the safe operator firing exposure limits (Army Research Labs Auditory Hazard Assessment Algorithm for Humans/AHAAH Dosing) when used with direct gas impingement firearms (such as the AR-15) that are being operated with barrel muzzle attached sound suppressors. The invention claimed here solves the problem of dangerous noise levels in the vicinity of the operator's ears, that continues to exist on these common firearms after adding most sound suppressors.

The invention improves on the prior art by hiding ejection port light signature, and significantly reducing the noise in the vicinity of the firer's ears associated with sound suppressed direct gas impingement type rifles such as the AR-15. The bolt carrier further reduces the bolt lug and chamber fouling associated with the prior art devices that have attempted to address the noise problem.

When the standard bolt carrier is replaced with a bolt carrier of the present invention, the gas that normally is exhausted out the ejection port at high pressure, is allowed to exhaust into an exhaust gas pocket in the bolt carrier group, wherein the exhaust gas pocket is functionally sealed in assembly by close operative association with the housing or receiver, and allows exhaust gas to expand and cool, prior to being redirected through a passage downward, into the forward fairly open portion of the firearms magazine well, where the gas is finally able to further expand and then escape out of the ejection port of the housing or the receiver at lower pressure and at dramatically lower sound levels.

The claimed invention differs dramatically from and is improved over what currently exists. The use of a pocket in the side opposite the ejection port allows gas to expand and impact surfaces, causing decay of the gases' pressure and velocity-which is directly correlated to exhaust sound intensity—in a semi-controlled atmosphere, prior to more controlled redirection of gas to the ejection port. This improves the sound safety performance over anything previously available. The bolt carrier pocket further reduces the bolt lug and chamber fouling associated with the other prior art devices that have attempted to address the noise problem.

The present invention's pocket in the bolt carrier allows gas to impact a forward surface of the pocket and be directed down and away from the chamber of the rifle, which results in reduction of sound at a level that outperforms the prior art, as well as reduces off-gassing in the vicinity of the firearm operator's proximally located airway.

Furthermore, the present invention further improves on the prior art by hiding ejection port light signature, and significantly reducing the noise associated with sound suppressor equipped rifles of type, in the vicinity of the firer's ears.

Especially when viewed with electro-optical night vision, the AR-15, and its derivatives, create a visible ejection port flash which is concealed with the bolt carrier of this invention. The lack of flash signature from the bolt may be an item of military interest.

In one aspect of the present invention, a bolt carrier group for a breechloading firearm, wherein the bolt carrier group is capable of operative association with a housing or a receiver that is provided with a cartridge case ejection port, the bolt carrier group includes the following: a bolt carrier having a first side and a second side defined and separated by a housing centerline of the housing or the receiver operatively associated with the bolt carrier group, wherein the first side is adjacent said cartridge case ejection port; a gas exhaust pocket disposed in the second side; one or more exhaust ports fluidly communicating the gas exhaust pocket with a an internal gas receiving portion of the bolt carrier; and the gas exhaust pocket defined in part by snug operative association with the housing or the receiver so that the exhaust gas received via the one or more exhaust ports expands in the gas exhaust pocket and is further directed via an aperture along a tortuous path to an external environment.

In another aspect of the present invention, the bolt carrier group further includes wherein a portion of the gas exhaust pocket comprises a notch in the bolt carrier that in combination with the snug fit of the housing forms an aperture, wherein the aperture directs the pockets received exhaust gas into a forward portion of an ammunition feed magazine of the breechloading firearm, wherein the ammunition feed magazine has a floorplate that may be provided with one or more gaps communicating with the external environment, wherein the gas exhaust pocket comprises a forward sealing surface dimensioned and shaped to direct the received exhaust gas through the aperture, wherein the aperture may be formed of geometry manufactured into the second side of either the bolt carrier or the housing or receiver, and wherein there are no gas exhaust ports along an exterior of the first side of the bolt carrier.

In yet another aspect of the present invention, a method of simultaneously reducing an ejection port light signature and reducing a decibel level of a peak operating noise level of a breechloading firearm, the method providing the following steps: diverting exhaust gas received by a bolt carrier operatively associated with the breechloading firearm, via ejection ports, to a gas exhaust pocket formed along an exhaust side of the bolt carrier opposite an ejection side of the bolt carrier, wherein the ejection side is adjacent a cartridge case ejection port of a receiver or a housing of the breechloading firearm; and further directing the exhaust gas through an aperture of the gas exhaust pocket, wherein the aperture is along a forward portion of the gas exhaust pocket, so that the exhaust gas urged into a forward portion of an ammunition feed magazine of the breechloading firearm.

It should be noted that the presence of ejection port side gas exhaust ports is not totally incompatible with the invention, as the opening of additional gas pocket ports will drop individual port pressures. The ejection port side exhaust ports can also be more forwardly located, changing their system timing, causing them to be opened after the gas pocket has already been pressurized, which could for example be advantageous to further reduce fouling. The lack of ejection port side exhaust ports in the exemplary embodiment of the invention should not be seen as limiting in scope.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a bolt carrier for gas impingement rifles equipped with a sound suppressor mechanism. The bolt carrier is configured to direct gas to a gas exhaust pocket, thereby lessening ejection port light signature and significantly reducing the peak noise in the vicinity of the firer's ears. The bolt carrier with a gas exhaust pocket further improves the operator air quality and reduces bolt lug and chamber fouling associated with the prior art devices that have attempted to address the noise problem.

Figure 1:
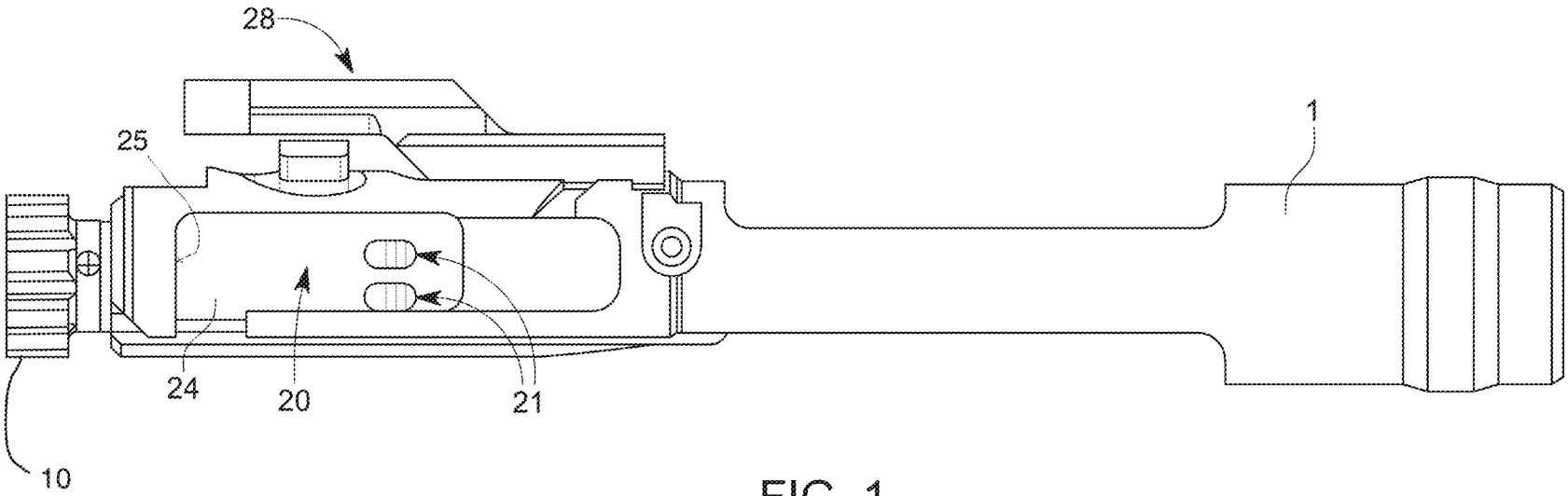
FIG. 1 is a non-ejection port side elevation view of an exemplary embodiment of an assembled bolt carrier 1 of the present invention, shown operatively associated with a bolt 10. The non-ejection port side being the side of the bolt carrier that faces the majority right-handed user during typical stronghanded firing of the firearm, and the side where the gas pocket 20 is disposed.
Figure 5:
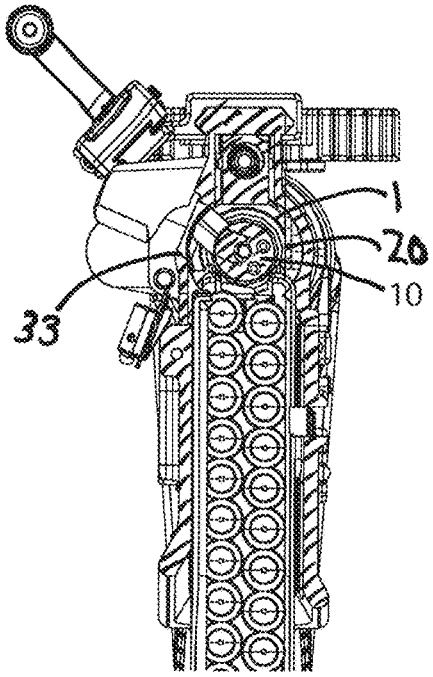
FIG. 5 is a rifle cutaway view from the muzzle side perspective looking toward the rear of the rifle. This drawing is of an approximate 0.06" increased bolt unlocking stroke, illustrating the cam-pin path version of the exemplary embodiment of the invention, showing the orientation of components at a location where the gas rings have passed the gas pocket exhaust ports by approximately 0.093". This view shows the forward part of the magazine and cartridges, for contextual understanding of the relatively open volume of that area of the magazine.
Figure 6:
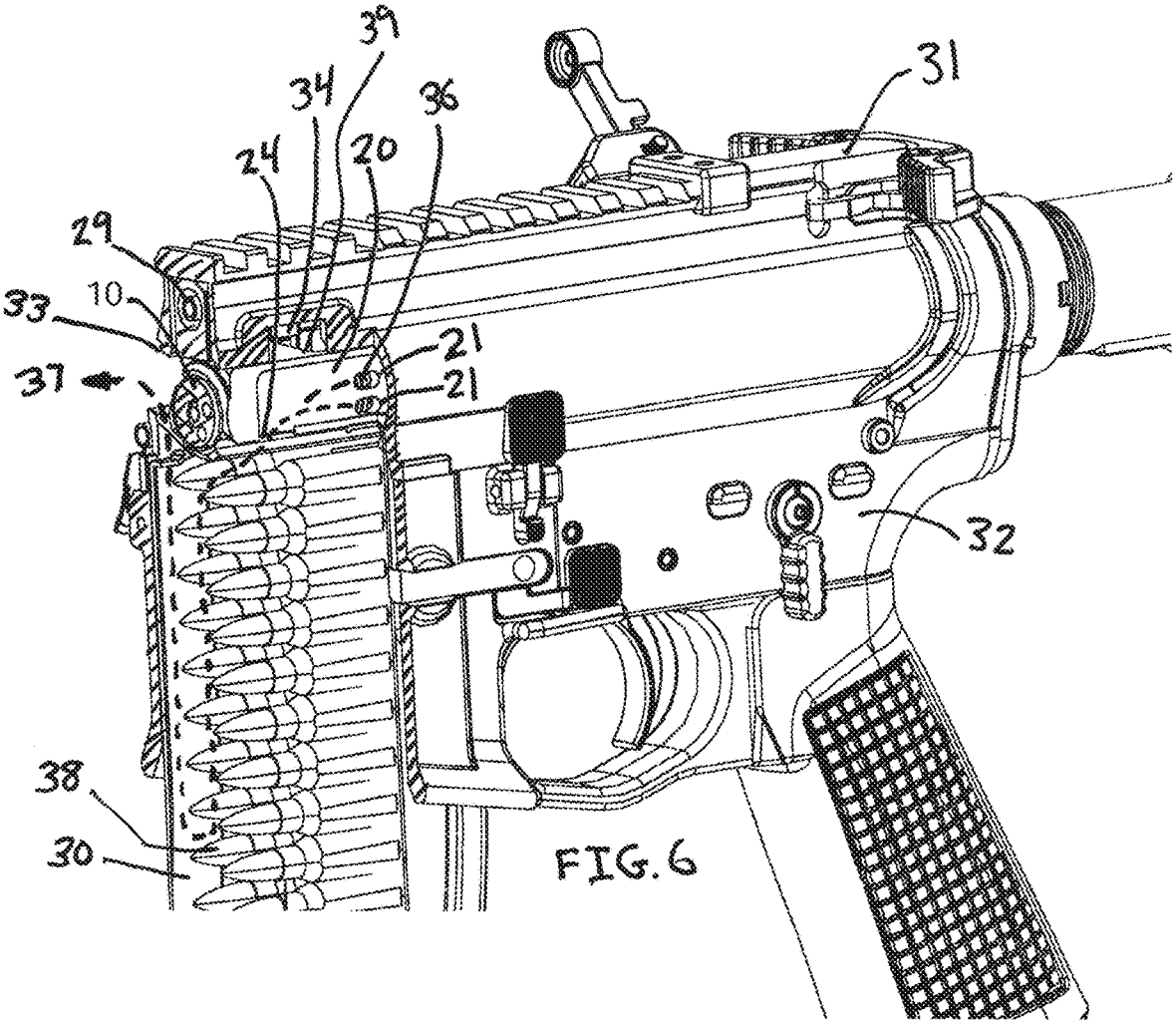
FIG. 6 is a gas pocket side perspective cutaway view of the rifle, affording contextual understanding of the gas pocket aperture position of the rifle at the same stroke position as in FIG. 5. This view is intended to show the aperture over the forward, open portion of the rifles ammunition feed magazine. It is worth noting that a standard cam-pin path bolt carrier version of the invention exists for compatibility of standard market bolts, which would put this identical carrier exhaust position 0.06" further forward than shown in FIG. 6.

Referring to FIGS. 1, 5, and 6, the present invention may include a bolt carrier 1 providing a gas pocket 20 along the non-ejection port side of the bolt carrier 1. The bolt carrier 1 has one or more exhaust slots 21 fluidly coupled to the gas pocket 20 provided with the body of the bolt carrier 1.

The gas pocket 20 may communicate with an aperture 24 in the non-ejection port side of bolt carrier 1. The shape and dimensions of the gas pocket 20 are such that when the bolt carrier 1 is moving rearward-under the urging of the expanding gases of ignited propellant that is channeled into the bolt carrier key 28 via the gas tube 29—the gas rings 36 of the bolt 10 pass the one or more exhaust ports or slots 21, allowing the said expanding exhaust gases to fill the gas pocket 20. The aperture 24 in the gas pocket 20 allows the expanded exhaust gas to be directed downward into the relatively open forward portion of the rifle's ammunition feed magazine 30, which in FIGS. 5 and 6 is located by a magazine well in lower receiver 32. After the exhaust gas expands into the magazine well it can escape the gaps in the magazine floorplate or through the opening ejection port 33 of the housing or receiver (not to be confused with the prior art bolt-carrier gas exhaust ports along the side of the bolt carrier adjacent the ejection port).

Forward sealing surface 25 of the exhaust gas pocket 20 provides an obstacle between exhaust gas and the bolt and chamber of the firearm. Forward wall or sealing surface 25 of gas pocket 20 can also act as a carbon scraper when the bolt carrier 1 cycles, keeping the inside walls of the upper receiver, or the like that the bolt carrier 1 is operably associated with, clean for operation. The sealing surface 25 stops gas from being able to push forward into the bolt lug/chamber area in a direct path. The gas pocket 20 pressurizes and the expanded lower pressure gas vents downward through the aperture 24 into the forward portion of the magazine well which is occupied only by a staggered double column of 0.224" diameter bullets 38 in a 0.794" inside width magazine (in the case of a 5.56 mm rifle), so there is plenty of open space up front (45% open space before considering the pointed shape of the bullet) for the gas to vent along path 37 into and expand in the magazine, before either leaving gaps at the magazine floorplate, or the opening ejection port of the housing or receiver as the bolt carrier travels rearward as shown in FIG. 6. In FIG. 6. the longer stroke and therefore 0.06" more rearward bolt carrier is shown at the moment of unlocking with the cam pin 34 at the forwardmost location in the cam pin track 39, and the gas rings 36 have passed the rear of the exhaust ports 21 by approximately 0.093" in this position, demonstrating the aperture 24 is capable of venting exhaust gas along the aforementioned path 37 into the forward open portion of the magazine well for expansion and cooling prior to exiting the ejection port 33.

Figure 3:
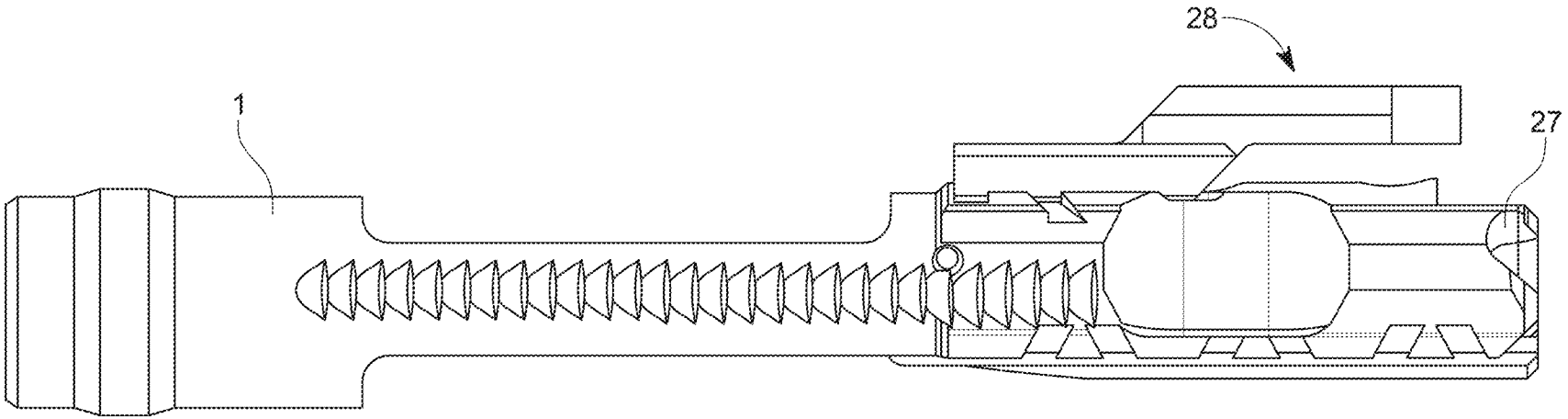
FIG. 3 is an ejection port side elevation view of an exemplary embodiment of the bolt carrier 1 of the present invention, showing the absence of prior art gas ports in the ejection port side of the bolt carrier 1.
Figure 4:
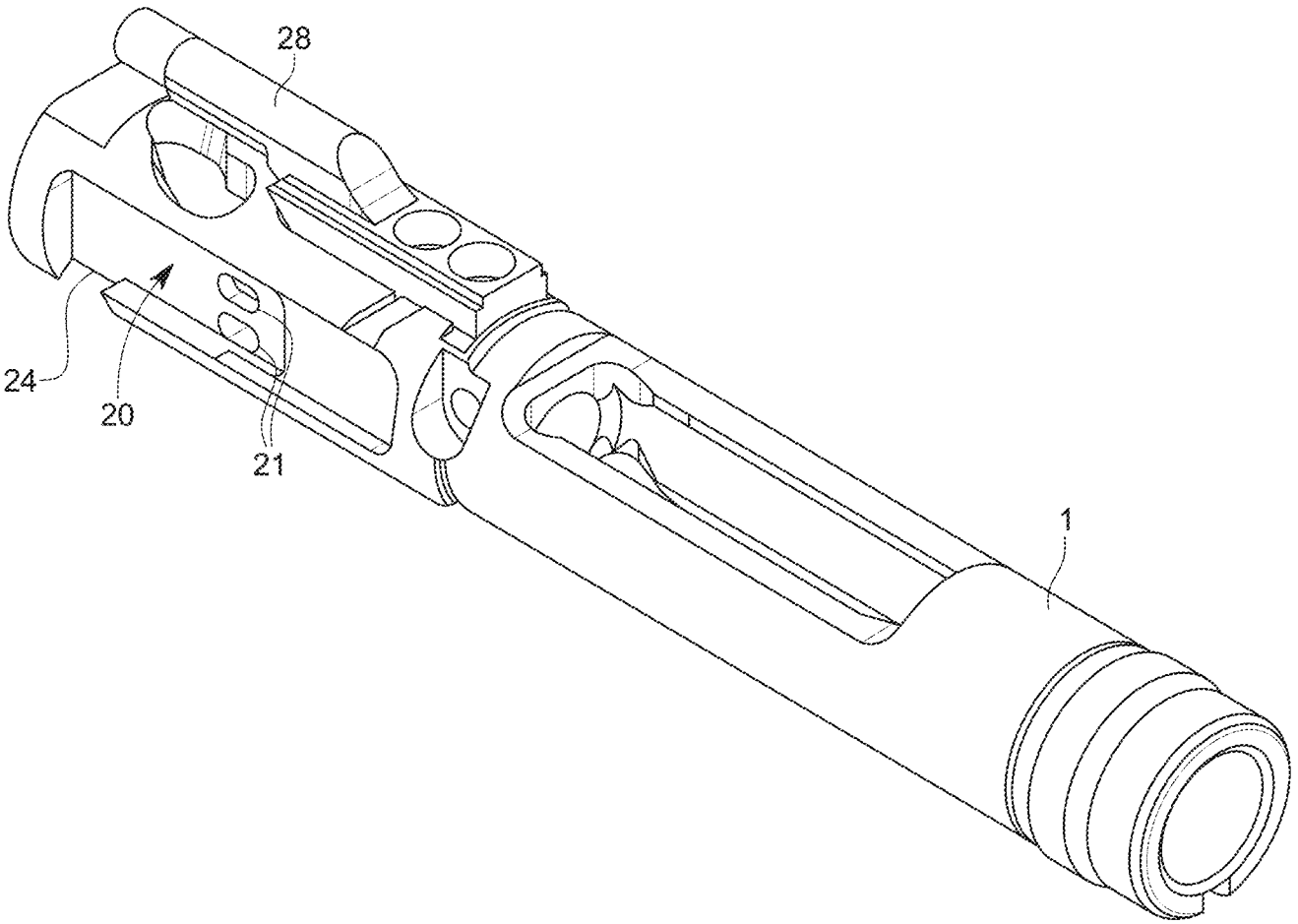
FIG. 4 is a top rear, non-ejection port side perspective view of an exemplary embodiment of the present invention.

Note that notch 27 in FIG. 3 is not related to the scope of the invention and is a safety feature in the event of a case head failure, intended to permit gas to exit the ejection port safely without splitting the bolt carrier 1 at the magazine feed lip clearance slots on the bottom of the bolt carrier, as is typical in prior art bolt carriers during catastrophic failure of a cartridge case from unsafe, over loaded and over pressure rounds.

Figure 2:
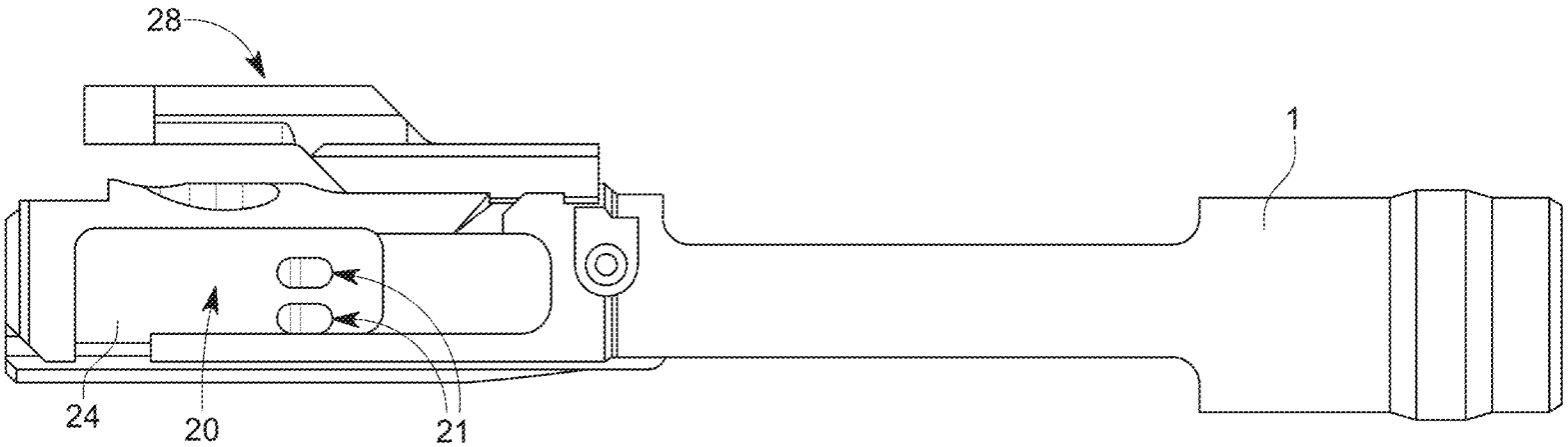
FIG. 2 is a non-ejection port side elevation view of an exemplary embodiment of the bolt carrier 1 of the present invention, shown without the bolt 10.

As shown in FIGS. 1, 2, and 3 the present invention may pertain to the addition of a gas exhaust pocket 20 to an AR-15 bolt carrier 1. When the prior art rifle is fired, gas flows through a port in the barrel of the rifle, into a gas tube 29, and through the bolt carrier key 28 on the bolt carrier 1. The gas enters a chamber in the bolt carrier 1 behind the gas rings of the bolt 10 and forces the bolt carrier 1 rearward independent of the bolt which is at this point engaged with lugs locked in battery inside the barrel extension. When the slot or plurality of slots 21 passes the gas rings 36 on the bolt, the gas is exhausted angularly forward into the gas pocket 20, and after initially expanding there, is directed downward and forward through the aperture 24.

The gas exhausted from slot or slots 21 is expelled into the gas pocket 20 on the non-ejection port side of bolt carrier 1 and is functionally restricted or bounded in assembly by the firearms upper receiver which is closely associated with the bolt carrier 1 during the firing cycle by a close diameter to diameter, sliding fit. The gas that has expanded into pocket 20, is directed downward, in part by reflecting off the sealing surface 25 through the notch or aperture 24 into the open forward portion of the rifle's magazine, allowing it to expand and diminish in pressure.

The gas that has passed through aperture 24 and expanded into the open forward portion of the rifle's magazine, is now able to exit the opening ejection port in the upper receiver as bolt carrier 1 has opened sufficiently and rapidly, to permit the gas to escape.

During the firing cycle, the forward sealing surface 25 of the gas pocket 20 in the bolt carrier 1 can shield the chamber from directly injected fouling, and act as a carbon scraper, keeping the sidewall of the upper receiver clean, and depositing any debris into the liberal tolerance, open forward portion and sidewall of the magazine of the rifle. The provision of allowance for the expansion and cooling of exhaust gas prior to escaping the rifle, allows the peak sound in the vicinity of the firer's ears to drop approximately 9 decibels. This effect is only measurable when the rifle is fired with a high-performance, barrel muzzle attached silencer. When the silencer is not present, the muzzle signature overwhelms the peak sound from the bolt carrier port exhaust, by virtue of being the louder of the two sounds present. So, this invention only increases the hearing safety of the AR-15, when a typical barrel end attached sound suppressor is already installed on the muzzle of the barrel. The bolt carrier of the invention, when tested, increased the right ear's safe exposure limit 250% according to the Army Research Laboratory, Auditory Hazard Assessment Algorithm for Humans (AHAAH) software tool, and Bruel & Kjaer Pulse sound metrology system. The measurement tools and dosing software used are currently state of the art. An approximately 9 decibels drop in shooter right ear sound is an incredible amount of safety gain over currently state of the art silencers used in conjunction with a standard bolt carrier group. At the present time, the military is pursuing low cyclic increase sound suppressors, and in order to be low cyclic increase, the state of the art in these silencers have unsafe unweighted and A weighted ear sound signature that 9 DB drop would often put into an ear safe profile, allowing the military to make both ear and respiratory hazards safe, rather than compromising hearing safety for respiratory safety.

Gas pocket 20 in bolt carrier 1 allows controlled environment expansion of gas exhausted from slot or plurality of slots 21. The open portion of the firearms magazine 30 provides a second controlled environment for expansion prior to exhaust gas reaching the open ejection port 33 where it can only then create an impulse noise signature. The expansion areas reduce the capability of the exhaust gas to create high impulse sound levels.

Manufacturing a bolt carrier with the features detailed in this document and using it in a direct impingement rifle such as an AR-15 with a muzzle attached sound suppressor will provide the additional reduction of operator ear sound previously mentioned in this application. The features could also be added to a bolt carrier with or without the ports on the ejection port side deleted, however the deletion of the ports on the ejection port side will promote the lowest ear sound levels.

Manufacturing the aperture or opening of the gas exhaust pocket into the housing or receiver that completes the operative association of the two components would be a mechanical re-arrangement that would provide similar function to the invention. This would rely on bolt carrier stroke timing and would become open and then again closed at two points in the carrier stroke, which may delete or improve a portion of functionality.

The gas pocket can be deleted, but this will have an adverse effect on the toxic gas in the vicinity of the firer's face. Deleting the pocket will permit greater pressurization of the firearms receiver to occur, allowing gas to be exhausted from the vicinity of the charging handle and the upper to lower receiver's thin communicative mating surface gap, as well as the trigger's hole in the fire control pocket. This gas is not breathable clean air, so it should be mitigated as well as possible with the gas pocket 20 and fluidly coupled aperture 24.

The slots could be ports; however, slots would better direct the gas exhaust distally away from the firer's face, toward the purposeful aperture 24, thereby improving air quality in the vicinity of the firer's face and better reducing localized pressure and debris associated wear on parts. The slots angular flow promotes a glancing, distal and diagonal flow of gas, reducing impact wear to the rifle's upper receiver. In testing, during the firing of thousands of rounds at a high rate of fire, the wear to the upper receiver caused by these features was not measurable or visible and did not wear or break through the hard coat anodizing.

Toxic gas is a major concern for auto-loading rifles. The ports in the ejection port side of the carrier were deleted, however they could be left behind, and there would still be less sound, because the pressure would be dropped by opening other ports, and the exhaust ports and or slots on the non-ejection port side of the carrier could be slightly proximally located relative to the ejection port side ports or slots, and that would be a mechanism to drop pressure before the ejection port side noise occurred, because proximal port locations are associated with earlier exhaust gas release during the firing sequence.

A method of using the present invention may include the following. A user may attach a silencer to the direct impingement firearm. This firearm could be an Ar-15 or AR-10 or another similar firearm. Replace the bolt carrier group with a bolt carrier group with the bolt carrier embodied in the present invention. When firing the firearm, the operator ear peak sound levels will have dropped approximately 9 decibels, and the dosing safety limit will have increased approximately 250% as indicated by our testing of this system. Further, the ejection port flash signature will have been eliminated.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A bolt carrier group for a breechloading firearm, wherein the bolt carrier group is capable of operative association with a housing or a receiver that is provided with a cartridge case ejection port, the bolt carrier group comprising:

a bolt carrier having a first side and a second side defined and separated by a housing centerline of the housing or the receiver operatively associated with the bolt carrier group, wherein the first side is adjacent said cartridge case ejection port;

a gas exhaust pocket disposed in the second side;

one or more exhaust ports fluidly communicating the gas exhaust pocket with an internal exhaust-pressurized portion of the bolt carrier;

the gas exhaust pocket defined in part by snug operative association with the housing or the receiver so that exhaust gas received into the gas exhaust pocket from the internal exhaust-pressurized portion of the carrier via the one or more exhaust ports expands in the pocket; and wherein a portion of the gas exhaust pocket comprises an aperture which directs the received exhaust gas into a forward portion of an ammunition feed magazine of the breechloading firearm.

2. A bolt carrier group for a breechloading firearm, wherein the bolt carrier group is capable of operative association with a housing or a receiver that is provided with a cartridge case ejection port, the bolt carrier group comprising:

a bolt carrier having a first side and a second side defined and separated by a housing centerline of the housing or the receiver operatively associated with the bolt carrier group, wherein the first side is adjacent said cartridge case ejection port;

a gas exhaust pocket disposed in the second side;

one or more exhaust ports fluidly communicating the gas exhaust pocket with an internal exhaust-pressurized portion of the bolt carrier;

the gas exhaust pocket defined in part by snug operative association with the housing or the receiver so that exhaust gas received into the gas exhaust pocket from the internal exhaust-pressurized portion of the carrier via the one or more exhaust ports expands in the pocket; and wherein the gas exhaust pocket comprises a forward sealing surface dimensioned and shaped to direct the received exhaust gas, via an aperture, along a tortuous path to an external environment.

3. The bolt carrier group of claim 2, wherein the aperture geometry is manufactured into the second side of the bolt carrier.

4. The bolt carrier group of claim 1, wherein there are no gas exhaust ports along an exterior of the first side of the bolt carrier.

5. A method of simultaneously reducing an ejection port light signature and reducing a decibel level of a peak operating noise level of a breechloading firearm, the method comprising:

diverting exhaust gas received by a bolt carrier optatively associated with the breechloading firearm, via ejection ports, to a gas exhaust pocket formed along an exhaust side of the bolt carrier opposite an ejection side of the bolt carrier, wherein the ejection side is adjacent a cartridge case ejection port of a receiver or a housing of the breechloading firearm;

directing the exhaust gas through an aperture of the gas exhaust pocket, wherein the aperture is along a forward portion of the gas exhaust pocket, so that the exhaust gas urged into a forward portion of an ammunition feed magazine of the breechloading firearm.

* * * * *